US008689711B1

(12) United States Patent
Grover

(10) Patent No.: US 8,689,711 B1
(45) Date of Patent: Apr. 8, 2014

(54) QUILTING METHOD AND FOUNDATION

(71) Applicant: Mary V. Grover, Meridian, ID (US)

(72) Inventor: Mary V. Grover, Meridian, ID (US)

( * ) Notice: Subject to any disclaimer, the term of this patent is extended or adjusted under 35 U.S.C. 154(b) by 0 days.

(21) Appl. No.: 13/684,319

(22) Filed: Nov. 23, 2012

(51) Int. Cl.
*D05B 11/00* (2006.01)
*D05B 93/00* (2006.01)

(52) U.S. Cl.
USPC ..... 112/475.08; 112/475.06

(58) Field of Classification Search
USPC ..... 112/402, 439, 441, 117–119, 103, 112/475.01, 475.18, 475.06, 475.08, 475.17
See application file for complete search history.

(56) References Cited

U.S. PATENT DOCUMENTS

| | | | | |
|---|---|---|---|---|
| 4,506,616 | A * | 3/1985 | Nixon | 112/475.08 |
| 4,631,765 | A * | 12/1986 | Casey | 5/417 |
| 4,646,666 | A | 3/1987 | Burrier | |
| 4,883,009 | A * | 11/1989 | Haselberger et al. | 112/475.18 |
| 5,099,773 | A * | 3/1992 | Codos | 112/475.08 |
| 6,021,726 | A | 2/2000 | Muraki | |
| 6,155,189 | A * | 12/2000 | Walner | 112/475.01 |
| 6,261,397 | B1 | 7/2001 | Repp et al. | |
| 6,263,816 | B1 * | 7/2001 | Codos et al. | 112/475.08 |
| 6,475,318 | B2 * | 11/2002 | Weiss | 156/93 |
| 6,696,129 | B1 | 2/2004 | Cotton | |
| 7,448,142 | B2 | 11/2008 | Geier | |
| 7,926,433 | B2 * | 4/2011 | Preston | 112/117 |
| 2011/0005441 | A1 * | 1/2011 | Roche | 112/117 |
| 2011/0041741 | A1 * | 2/2011 | Cohen | 112/439 |

OTHER PUBLICATIONS

Battilizer 115. Catalog entry [online]. HoopSisters, [retrieved on Nov. 21, 2012]. Retrieved from the Internet: <URL: http://www.hoopsisters.com/products/BATTILIZER-115-%28Shipping-to-US-addresses-Only%29.html>.

* cited by examiner

*Primary Examiner* — Ismael Izaguirre
(74) *Attorney, Agent, or Firm* — Your Intellectual Property Matters, LLC; Robert A. Frohwerk

(57) ABSTRACT

This method of producing quilts, or quilt components, uses a patterned quilt foundation to assist in the creation of reversible quilts, and reversible quilt components. The method uses a batting, layered between and affixed to patterned web material wherein the pattern lines match the front layer to the back layer for various patterns. This allows the quilter to create quilt block designs on the front as well as the back of a block using the pattern lines for the accurate placement of material on each of the two faces. The method is applicable to strip, square, triangle, rectangle and diamond shapes as well as any combination of those shapes. To maintain registration from one face to the other, the quilting of the piece is accomplished at the same time as the front and back pieces of material are sewn to the pattern.

2 Claims, 5 Drawing Sheets

QUILTING METHOD AND FOUNDATION

FIELD OF THE INVENTION

The present invention relates generally to methods of producing single-sided and two-sided quilts, especially for simultaneously producing both sides of a two-sided quilt. More specifically, the described methods are facilitated by the use of a patterned foundation as a guide for the production of such quilts.

BACKGROUND OF THE INVENTION

Although quilting is not unique to the United States, it is a traditional art form that was well developed by American pioneers of the 19th century. Early quilts were primarily utilitarian, and most often used as a blanket for protection against the elements. They typically comprised two fabric sheets with some form of batting between them. The batting provided insulation while the outer sheets protected it. Since the batting was often scavenged from scraps of other fabric or various wads of cotton, wool, or other fibrous materials, stitches were sewn through the layers at intervals to stabilize the batting so that it remained relatively evenly distributed and did not migrate into lumps.

As the art form developed, the top sheet, which had been a single piece of fabric, was replaced by mosaics that were created by stitching together many small pieces of fabric. Some of these mosaics were created full-size to replace the top sheet in its entirety, while other smaller mosaics may have been appliquéd to the top sheet for decoration. The backside of the quilt generally remained as a solid, unadorned sheet.

Another development was the use of quilting stitches. Although initially these were merely intended to avoid migration of the batting, they became another means of artistic expression. Stitches were placed in patterns to describe the outlines of flowers, animals and other items seen in nature. Other common stitch patterns included stars, hearts and a variety of symbols. Some of the quilt stitches were used to trace the pieced pattern from the top sheet, while other stitches were simply decorative. While the men from among the American pioneers gathered as neighbors for barn raisings, the pioneer women gathered to meticulously apply their stitches to large quilts.

As quilts have become less utilitarian, they have advanced artistically to the extent that they are used as wall hangings as often as for bed coverings. Though many quilters and quilt aficionados still give high regard to the detailed regularity and patterns of stitches, the average attendee at present-day quilt shows is more likely to be drawn visually to a quilt on account of its pieced top, whether for its colorful pattern or the intricacy or detail of the piecing. Occasionally, quilts are created that have both of the front and back faces pieced to create a double-sided quilt. This is generally done in order to provide a single quilt that is usable for two different themes, such as for spring and summer, or for Thanksgiving and Christmas.

The easiest way to produce a quilt wherein both faces are pieced is simply to create each face by piecing it independently of the other. Appropriate borders are then added so that the sizes of the two faces match, then the two faces are sandwiched with the batting and the composite is stitched together. In many cases this is acceptable. Difficulty with this approach arises when it is desired to use quilting stitches to accent the pieced work of one face or the other, since it is likely that stitches used to trace the pieces of one face will appear out of character against the opposite face. Even if the two faces were pieced in identical patterns, with one being the mirror image of the other, it would be difficult to properly register them so that stitches quilted on one face would properly align with the opposite face.

BRIEF SUMMARY OF THE INVENTION

The presently described methods and materials facilitate the construction of quilts in which both faces present pieced patterns with quilting stitches that are aligned from one face to the other. The process begins by acquiring a foundation having pattern lines on one or both faces. Where such a patterned foundation is not available in a prefabricated form, it may be constructed by various methods.

One method of constructing a patterned foundation is by applying a patterned stabilizer to one or both faces of a batting. This requires appropriate alignment between the patterned stabilizer on one side of the batting and that on the other. Pattern lines may indicate a variety of shapes, or most often they will be simply an array of parallel lines or a rectangular grid. Where a pre-patterned stabilizer is either not available or not desirable, a second method of constructing a patterned foundation involves application of a pattern to an unmarked stabilizer. In a third method of constructing a patterned foundation, unmarked stabilizers are applied to both sides of the batting and an appropriate pattern is stitched or punched through the layered assembly to produce a pre-quilted patterned foundation.

With appropriate attention to the patterns desired for each side of the quilt, the pieces are laid out in the pattern design. Depending on the quilt design, pieces are either applied individually or they are pre-sewn into design strips or rows prior to being placed directly onto the patterned foundation material. The pieces or rows are then placed on the front and back of the patterned foundation directly opposite each other. The first row or piece for the front of the quilt is placed right side up with a leading edge of the row at the appropriate pattern line. Similarly, the first row or piece for the back of the quilt is placed against the foundation with its right side out and with its leading edge at the same pattern line. The second piece or row for each of the front and back faces of the quilt is then placed with its right side against the right side of the first row and aligned to the same pattern line. This assembly of the first and second front pieces or rows, the foundation, and the first and second back pieces or rows is then stitched together with an offset for an appropriate seam allowance, generally ¼ inch, from the first pattern line. Folding these second front and back pieces or rows along the stitching and pressing them flat against the foundation with their finished surfaces facing outward completes the attachment of the first and second pieces or rows. When producing a quilt having a single-sided design, a fabric backing of the appropriate finished size is placed against the back face of the foundation and basted into place. As the design pieces or rows are added to the front face of the quilt, the backing is incorporated and attached in the process.

The third row, and each subsequent row, is laid out with its finished surface against the finished surface of the preceding row with the leading edge of the current row aligned to the trailing edge of the previous row. This assembly is then stitched along the next indicated pattern line using the same seam allowance. For a two-sided quilt the stitching in this step captures five layers of material, those being two design pieces from each of the front and back plus the foundation. In a single-sided quilt two layers of the design pattern are stitched to the foundation while also capturing the backing fabric in the process.

After the third, or subsequent, pieces or rows are stitched, the current row, which faces toward the foundation, is folded outward along the stitching and then back flat against the foundation. For a two-sided quilt this step pertains to pieces applied to both the front and back of the foundation. The newly applied pieces are then pressed into place thereby indicating the appropriate pattern line for the next row or pattern piece.

Subsequent precut rows or pieces for each of the front and back faces are then selected and laid into place with their finished surfaces against the finished surfaces of the previously attached row or pieces. The leading edges of these subsequent pieces are aligned with the next pattern line on the foundation, again with an appropriate offset for a seam allowance, and stitched into place. This sandwich comprises, in sequence from front to back, the leading edge of a current front piece, the trailing edge of the previous front piece, the foundation, the trailing edge of the previous back piece, and the leading edge of the current back piece. After these layers are stitched, each of the current front and back pieces is folded over the just completed stitching so that all finished surfaces are facing outward, away from the foundation. These current pieces are then pressed into place.

This process continues, using the same sequence as described above for successive pieces for each of the front and back faces until the quilt or quilt block is completed. It will be recognized that as the above described process proceeds, each piece that is successively applied to the front and back faces of the quilt block will be folded over to hide the stitching that captures its leading edge. The final edge of the quilt is typically finished with a binding, possibly with intervening borders. Quilt blocks may be bound off or attached to other quilt blocks by lattice material.

Similar techniques are described for quilt blocks where the patterns on the front and back faces are not mirror images of one another. With careful attention to detail, this technique is also applicable to patterns that are non-rectangular.

BRIEF DESCRIPTION OF THE DRAWINGS

The particular features and advantages of the technique briefly described above as well as other objects will become apparent from the following description taken in conjunction with the accompanying drawings, in which.

Figure 1:
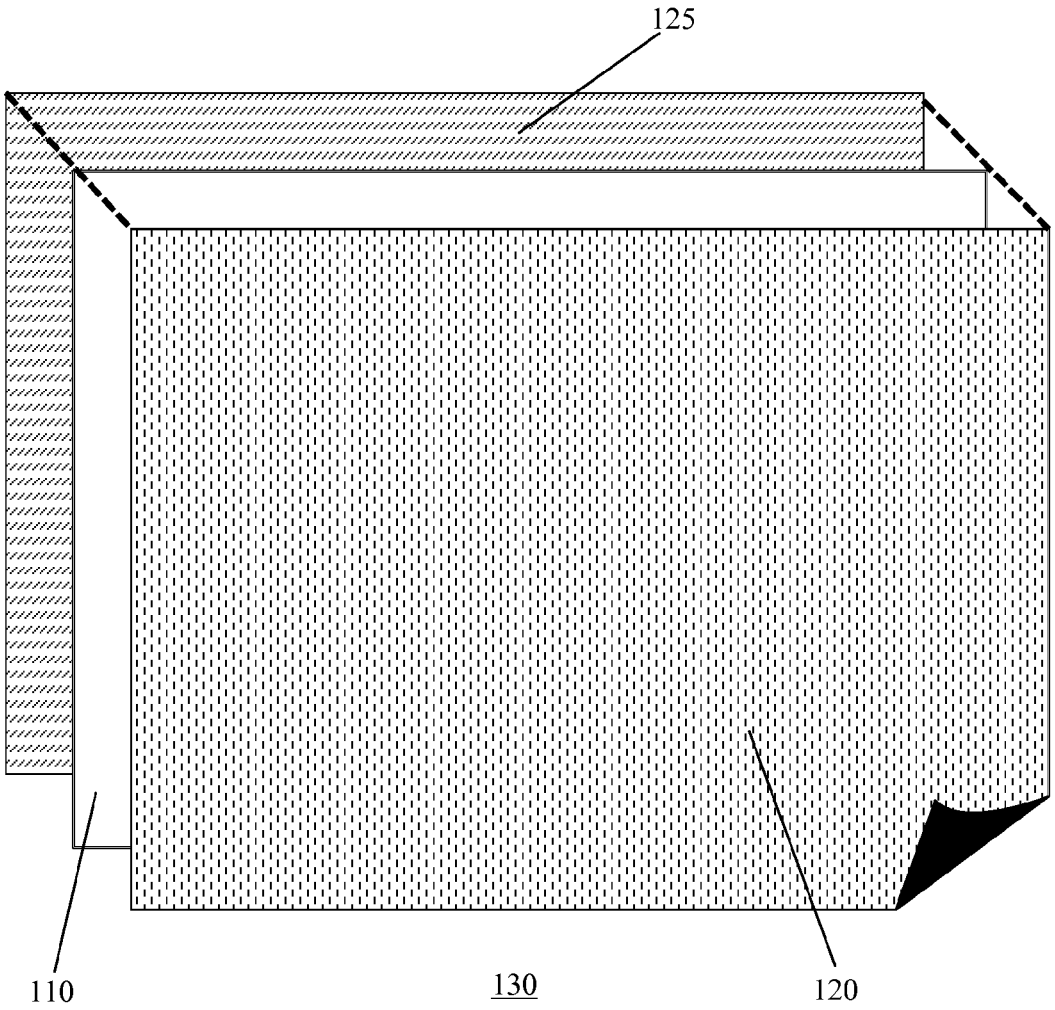
FIG. 1 is an exploded view of a two-sided quilt foundation showing a batting between two stabilizers.
Figure 2:
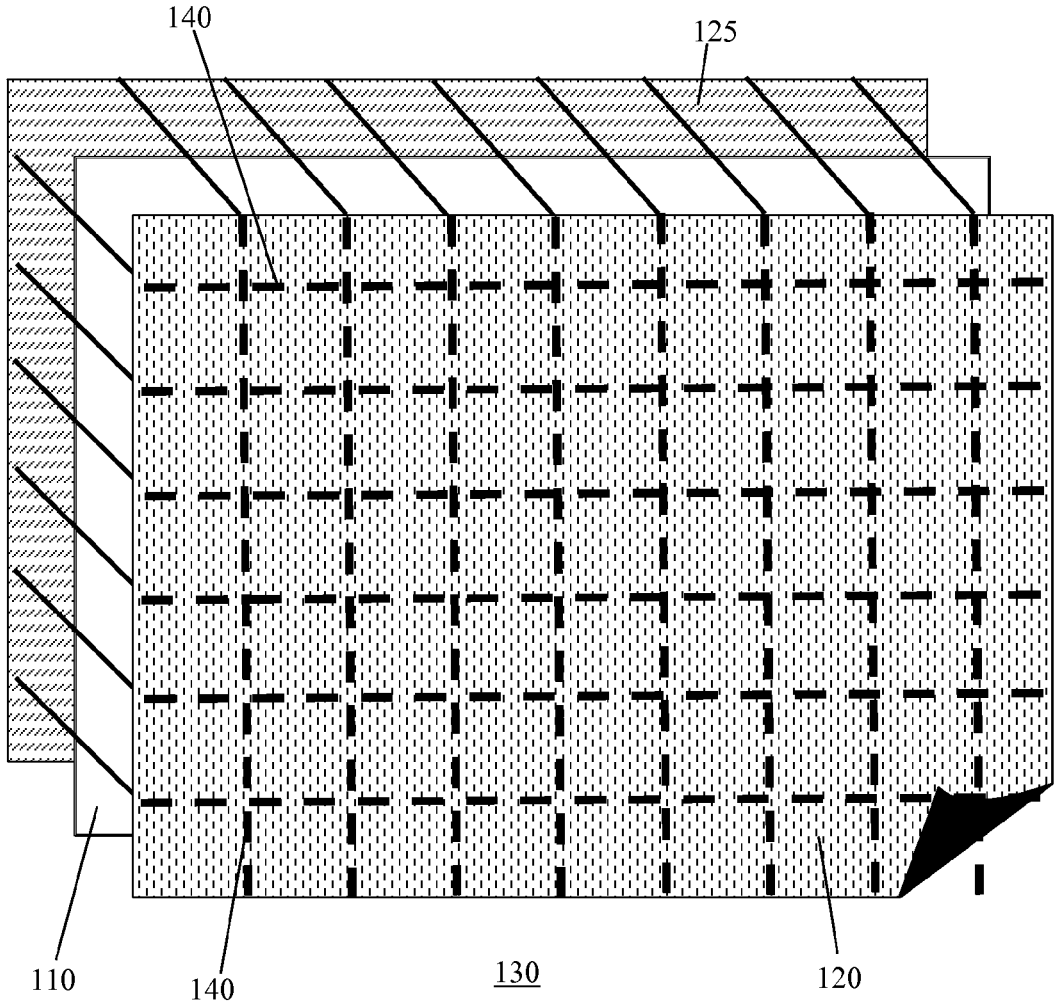
FIG. 2 depicts a two-sided quilt foundation after a basic pattern, shown here as a rectangular grid, has been stitched through it.

The following Reference Numbers may be used in conjunction with one or more of the accompanying FIGS. 1-5 of the drawings:

100 quilt or quilt block
110 batting
120 stabilizer, front
125 stabilizer, back
130 foundation
140 pattern line
150 stitches on pattern line
210 first back patchwork design piece
220 second back patchwork design piece
310 first front patchwork design piece
320 second front patchwork design piece

DETAILED DESCRIPTION OF THE INVENTION

The presently described technique may be implemented in a variety of ways to solve the problem of creating double-sided quilts in which quilting stitches applied at one face are readily aligned to a pattern on the opposite face. For a single-sided quilt having a single, un-pieced, fabric on its back face, the backing material is captured as the single-sided design is sewn to the front face, thereby producing a quilted back face as the front face is developed.

In its simplest form a quilt is a sandwich of batting between two face sheets, as depicted in FIG. 1. The two face sheets are then bonded together through the batting to stabilize the sandwich in order to avoid migration of any of the layers into puckers or lumps. The batting provides insulation while the face sheets protect the batting. For quilts that are primarily utilitarian, and depending upon the materials being used, bonding may be accomplished by staples or by various tacking methods such as heat-sensitive adhesives. For artistic quilts bonding is accomplished by thread that is stitched through the sandwich. The techniques described here enable beginning quilters to create artistic quilts, whether single-sided or reversible double-sided. With appropriate selection of materials these techniques may also be used for utilitarian and other mass-produced quilts.

Many people enjoy selecting fabric and piecing a quilt top together, but often for a variety of reasons that quilt top does not receive the quilting stitches to finish it as a quilt. Either the would-be quilter doesn't have the right equipment to produce a quilt, such as a long-arm quilting machine, or they don't have the time or desire it takes to do the quilting by hand. The technique described here is helpful for those who enjoy piecing quilts, especially reversible ones, but don't "quilt", or for those who sew but do not, or cannot, or do not desire to "quilt".

An ordinary sewing machine, with the addition of a quilting foot and a ¼ inch foot, to establish a proper seam allowance, is all that is necessary in order to implement the method described here. Use of this technique, along with associated materials, provides increased accuracy for the placement of lines for material quilt patterns. It not only works well for single-sided quilts, but also enables piecing of a reversible quilt, that is, one having two sides, each of which displays a pieced design. This method provides for different color schemes on the two sides as well as reverse block patterns. Quilting stitches are applied as a matter of process with the foundation being pre-quilted using pattern lines as individual pieces or rows are attached to the foundation. Since batting is inserted between the two faces of the quilt as the faces are pieced, the result is a stable quilt where the two sides are well aligned each to the other.

The description of the technique will begin from the point of view of an individual person desiring to produce a handmade artistic quilt having two embellished faces. The process starts with selection of a batting material of appropriate size in accordance with the intended finished product. A fusible stabilizer material is applied to both sides of the batting.

A stabilizer in the present context is a material that is used to strengthen and stabilize an attached fabric to prevent stretching. Fabric for a quilt will generally be a woven material but a stabilizer may also be used to stabilize a knitted fabric. A stabilizer may be woven or non-woven with the latter generally providing greater stability. Another desirable feature of the stabilizer is flexibility so that the stabilized material does not become stiff.

Sheets of fusible material provide a heat-bondable adhesive for attachment of one fabric to another. Many stabilizers include some form of interfacing material having a fusible surface that may be ironed onto another fabric.

Batting used as a foundation in present day quilts is generally made of cotton or polyester or a blend of the two textile types. When the presently described technique makes use of heat-bondable materials, it is best to select a batting that is at least 80% cotton since polyester tends to shrink when heated. Regardless of material, the batting must be stabilized. It is best to stabilize both sides of the batting since a foundation that is stabilized only on one side will have a different feel and workability from the stabilized side to the non-stabilized side.

Details of the Present Method

The basic technique described here begins (FIG. 1) by joining a stabilizer (120, 125) to the two sides of a batting 110 to form a foundation 130. Some quilters may find it convenient to use a fusible stabilizer that is heat-bonded to the batting 110 in order to quickly produce a foundation that is easily handled without concern for separation of the layers. The stabilizer 120 on one side will generally have a preprinted pattern of some format to act as guidelines throughout the quilting process. A grid pattern is common, such as that shown in FIG. 2 where the pattern has been stitched through the foundation to join the stabilizers (120 and 125) to the batting 110.

One facet of the presently described method is to provide an equivalent pre-made foundation product. One means of producing such a foundation would be to feed a pre-patterned fusible stabilizer, a batting material, and a second fusible stabilizer through a pair of heated rollers to produce a three-layer foundation. Another means of producing the foundation, that is applicable to home production as well as mass-production in a factory, uses uncoated, non-fusible, stabilizers with the batting sandwiched between them. The pattern, gridded or otherwise, is applied by stitching through the three layers. For home production, it is convenient to have one of the stabilizing layers preprinted to guide the stitching, whereas for factory production the stitching would be applied under computer control.

One facet of the above described technique is its applicability to home production using readily available materials. Where batting is not available with a pre-printed rectangular grid or other pattern, an individual quilter may produce such batting for personal use. This is accomplished by applying a stabilizer to the selected batting. One common means of applying the stabilizer is by heat bonding. A heat-bondable stabilizer may be selected or an equivalent material may be produced by using a heat-bondable interface in conjunction with a standard stabilizer. The rectangular grid or other pattern may be applied to the stabilizer by various methods.

Another aspect of the described technique leads to the manufacture of pre-printed material. Such material comprises batting that is marked with a rectangular grid. Since the printing industry has difficulty printing on soft material such as batting, one solution is to pre-apply a stabilizing interface to both sides of the batting. The printed grid or other pattern need only be applied to one surface. This anticipates some difficulty in maintaining registration between the patterns when attempting to print double-sided fabric for batting. While a double-sided grid is considered here, it is not necessary since stitches placed along a grid on one surface serve to replicate that pattern on the opposite surface.

Yet another consideration related to the presently described technique is the process which would be used to produce a double-sided, stabilized, patterned batting. For home use to generate patterns on a stabilized batting, a tool such as a rotary punch would be useful. A handheld rotary punch may press small, evenly spaced holes through the batting, or insert a basting thread at regular intervals, or it may press dimples into the batting that are deep enough to be recognizable from the opposite side. Another such marking tool would impress ink onto a surface of the stabilized batting with sufficient penetration to be recognized through the batting. Alternately, a handheld rotary tool that includes a heat source may be used to bond a stabilizer having a heat sensitive interfacing to the batting at a series of tack points which serve both as stitching and as pattern guides.

Figure 3:
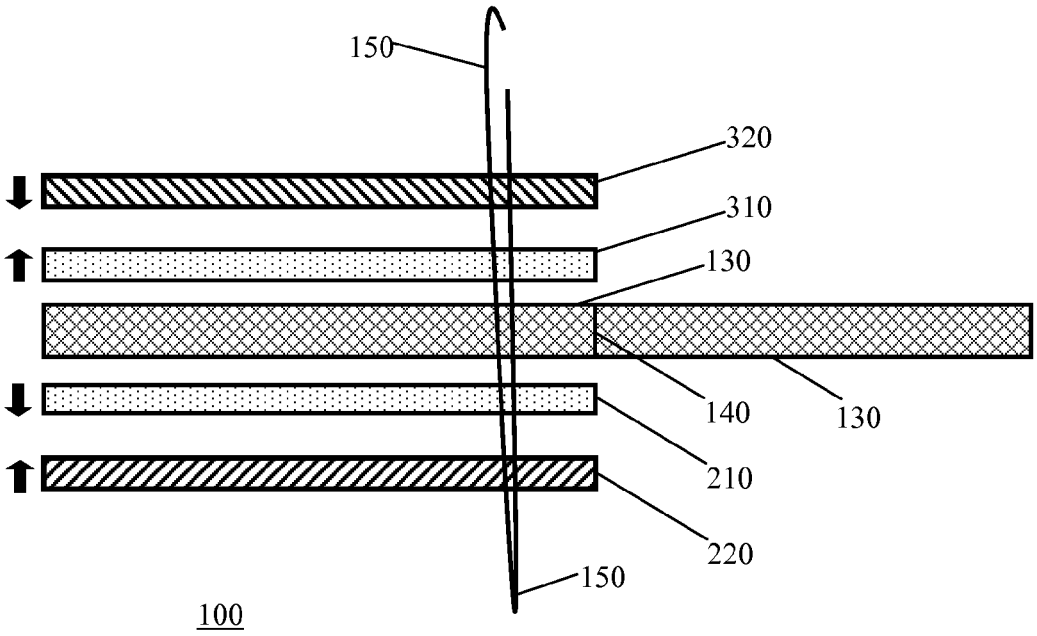
FIG. 3 illustrates the first phase of the described method of layering a quilt with the first and second patchwork design pieces stitched to the front and back.

The quilting project proper begins, in FIG. 3, after acquiring a suitable foundation 130 and two sets of fabric pieces (210, 220, 310 and 320). A first set of fabric pieces is to be applied to the front of the foundation to create the front patchwork design pattern. Applying a second set of fabric pieces to the back of the foundation creates the back patchwork design pattern to produce the finished quilt 100. These sets of fabric pieces are merely exemplary to describe how a quilter would begin to use the present method, and a quilter would quickly recognize that the process is to be repeated with subsequent pieces until the entire patchwork design is completed on both faces of the quilt. For quilt designs that include non-rectangular pieces, such as triangles or arcs, it is recommended that the patchwork pieces for those portions of the design be pre-sewn into design strips or rows prior to being placed directly onto the patterned foundation material so that all fabric pieces may be treated as being rectangular.

Figure 4:
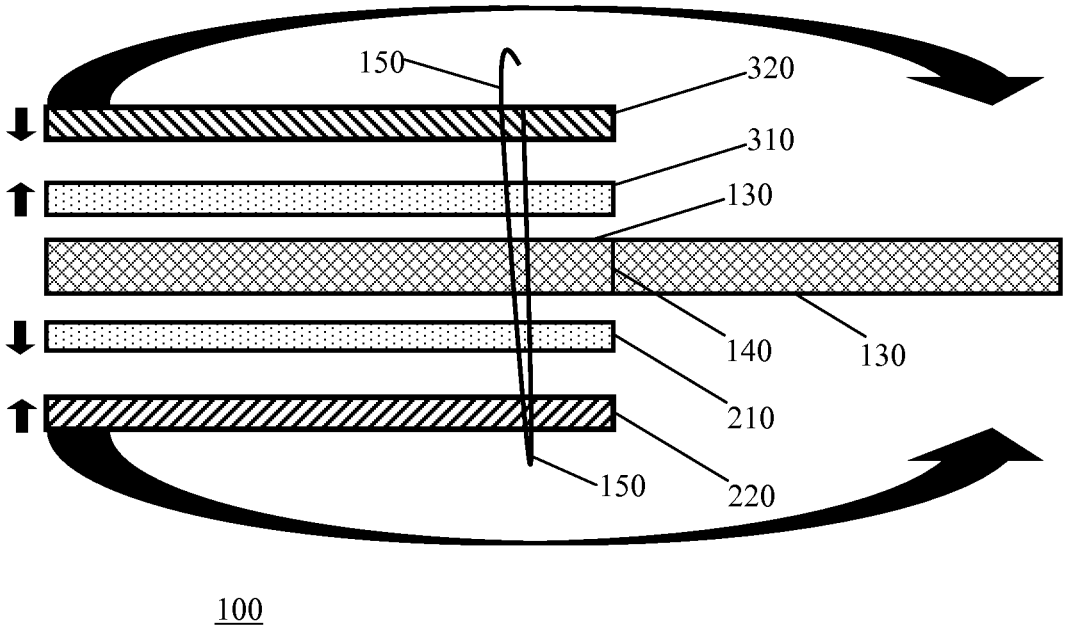
FIG. 4 shows the second phase of the described method as the second patchwork design pieces of the front and back are folded over.
Figure 5:
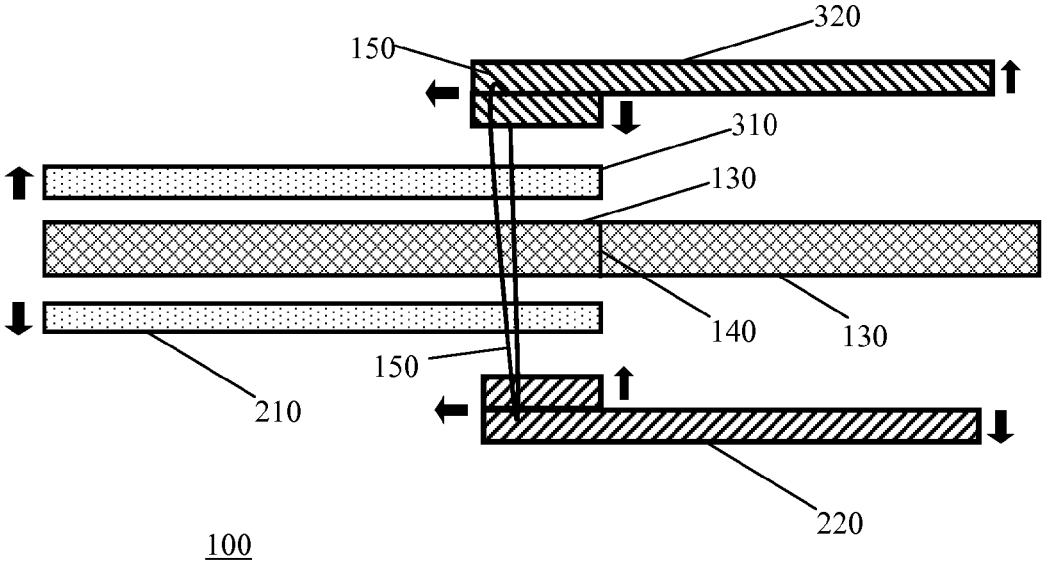
FIG. 5 shows an expanded elevation view of the final phase of the described method after the second patchwork design pieces of the front and back have been pressed into place.

It is to be noted here that each of the patchwork design pieces has a "right" surface and a "wrong" surface, indicated in FIGS. 3-5 by the solid arrows pointing in the direction of the "right" surface. Depending upon the type of fabric being used, the "right" surface may have a more finished texture than the "wrong" surface. Without regard to whether or not the right and wrong surfaces of the fabric differ in their finish, as used here the "right" surface refers to the surface that is to be visible in the completed quilt, whereas the "wrong" surface refers to the surface that is to face inward toward the foundation. For ease of reference the quilt will have a front, or top, and a back, or bottom, side. These terms are for reference only since the presently described process produces a two-sided finished quilt 100 that is reversible.

The piecing of the quilt begins at an edge of the design pattern. The first patchwork design piece 210 from the design for the back face of the quilt is selected and placed against the back of the foundation 130 with its right surface facing outward away from the foundation. The first patchwork design piece 310 from the design for the front face of the quilt is selected and placed against the front of the foundation 130 with its right surface also facing away from the foundation. The two patchwork design pieces (210, 310) are aligned to the first pattern line 140 on the foundation 130. The second pieces or rows (220 and 320) are then placed on both of the front and back of the quilt assembly with their right surfaces inward against the first pieces or rows and aligned to the same pattern line as shown in FIG. 3. The quilter then stitches (150) through the entire assembly from the first face using an offset appropriate for a seam allowance, generally ¼ inch, from a pattern line 140. This initial stitching 150 provides stabilization of the layered assembly. It also provides registration and alignment between the two faces as the stitches offset from the pattern line go through the opposite face which serves to avoid accumulation of any placement errors.

The process continues as shown in FIG. 4 where the second rows or pieces of both the front and back are folded over, as indicated by the heavy arrows, so that their right surfaces are exposed. Their wrong surfaces are then pressed (FIG. 5), as by ironing, to be tight against the foundation 130. As can be seen, this hides the stitches that were placed with a seam allowance offset from the first pattern line 140.

The right surfaces of the third and each subsequent patchwork design pieces or rows (220 and 320) for each of the back and front faces are then placed against the right surfaces of the previous work at the next desired pattern line. Another set of stitches is then inserted with the proper offset for the seam allowance along that pattern line through the current back and front patchwork design pieces (220 and 320), the previous back and front patchwork design pieces (210 and 310), and the foundation 130. The current pieces of the back and front are then folded over to cover the stitches that bind them to the foundation. The process continues until, working from one edge of the quilt toward the opposite edge, both of the back and front design patterns are completed simultaneously.

In situations where any patchwork design piece from the back face has a different width from that of the front face, the above procedure must be modified. In such instances the wider of the back or front patchwork design pieces will be folded back out of the way over its corresponding previous patchwork design piece to avoid interference. The appropriate second set of stitches will then be applied so as to bind only the narrower of the back or front patchwork design piece to its corresponding previous patchwork design piece and to the foundation. The next patchwork design piece is then selected for the back or front face that lags in the progression of the pattern development. This process continues as the quilter is wary to avoid stitching through any patchwork design piece at a distance from the trailing edge that is greater than the seam allowance. The result is that there will be no case in which top-stitching will remain exposed without being covered, and therefore hidden, by placement of a subsequent patchwork design piece.

The same technique is applicable to a single-sided quilt where a full-size backing sheet may be incorporated as the front design pattern is stitched, in which case the lines of stitching will show on the backside of the quilt. Alternately, the full-size backing sheet may be applied later and used to hide the stitching used in the construction of the front face.

Using this technique while progressively working from one edge to the other, the placement of each row of stitches offset from a pattern line serves to maintain alignment from the front side to the back side of the quilt. If the stitches should happen to deviate from the pattern line, it will be readily apparent and compensation can be made or the stitches removed immediately before continuing so that no error is accumulated. The pattern lines serve as placement lines for the edges of the pattern pieces or rows and as guidelines for stitching with the seam allowance.

A slight variation in the process allows for situations in which the pattern on one side of the quilt must be aligned to a different spacing than on the other side. In one instance, suppose that the pattern on the front side requires a 1-inch grid whereas at some point in the pattern the back side requires a 3-inch grid. After the leading edge of the 3-inch piece is applied to the back, it is simply kept flat with its right surface facing the right surface of the previous row, out of the way, while the front side continues until the front side catches up with the next grid line needed for the back.

It is quite possible that the design of either the front or the back of a quilt will include something other than strips and rectangles. In such cases some planning and pre-assembly is required. For patterns made from pieces other than strips, for instance, triangles as in the points of a star, or circular segments or arcs, the pattern for a quilt block may be redefined into a set of strips. These strips are pieced together in a separate workspace and then applied to the two-sided quilt using the technique previously described for strips of varying widths. The pattern that is used with the presently described technique will be defined by the pattern having the narrower strip at any point in the process, whether from the front or the back side of the quilt.

Pattern lines need not be evenly spaced or even straight or parallel, though these factors are most common. The described technique may make use of diagonal lines or arcs as appropriate to accommodate the patterns on the two faces of the quilt, which includes at least their common denominator.

While the present technique has been described with respect to preferred methods and materials for the construction of reversible quilts, there is no implication to restrict the present description to preclude other implementations that will be apparent to those skilled in the related arts. It is recognized that the described methods and materials may be implemented in alternative manners. Therefore, it is not intended that the invention be limited to the disclosed embodiments or to the specifically described details insofar as variations can be made within the spirit and scope of the appended claims.

What is claimed is:

1. A method for producing a two-sided quilt, the method comprising:

(a) acquiring a patterned foundation having a front face and a back face;

(b1) acquiring a first set of fabric pieces for a front design pattern, wherein each piece of the first set of fabric pieces has a right surface and a wrong surface and a leading edge and a trailing edge;

(b2) acquiring a second set of fabric pieces for a back design pattern, wherein each piece of the second set of fabric pieces has a right surface and a wrong surface and a leading edge and a trailing edge;

(c1) selecting a first piece from the first set of fabric pieces to become a current front piece;

(c2) selecting a first piece from the second set of fabric pieces to become a current back piece;

(c3) identifying a first pattern line as a current pattern line;

(d1) aligning the leading edge of the current front piece to the current pattern line on the front face of the foundation, wherein the wrong surface of the current front piece is in contact with the foundation;

(d2) aligning the leading edge of the current back piece to the current pattern line on the back face of the foundation, wherein the wrong surface of the current back piece is in contact with the foundation;

(e) redesignating the current front piece as a previous front piece, and the current back piece as a previous back piece;

(f) selecting a successive piece from the first set of fabric pieces to become the current front piece, and selecting a successive piece from the second set of fabric pieces to become the current back piece;

(g1) aligning the leading edge of the current front piece to the current pattern line and to the trailing edge of the previous front piece on the front face of the foundation, wherein the right surface of the current front piece is in contact with the right surface of the previous front piece;

(g2) aligning the leading edge of the current back piece to the current pattern line and to the trailing edge of the previous back piece on the back face of the foundation, wherein the right surface of the current back piece is in contact with the right surface of the previous back piece;

(h) stitching a current set of stitches offset by a seam allowance along the current pattern line to attach the previous front piece, the current front piece, the previous back piece and the current back piece to the foundation;

(i1) folding the current front piece over the current set of stitches to place the wrong surface of the current front piece in contact with the foundation;

(i2) folding the current back piece over the current set of stitches to place the wrong surface of the current back piece in contact with the foundation;

(j) identifying a next pattern line as the current pattern line; and (k) repeating the above steps of redesignating (e), selecting (f), aligning (g1, g2), stitching (h), folding (i1, i2), and identifying (j), until the first set of fabric pieces and the second set of fabric pieces have been exhausted.

2. The method of claim 1, wherein the step of identifying (j) includes locating the next pattern line that is furthest removed from the current pattern line of the stitching step (h) and is covered by both of the trailing edge of the previous front piece and the trailing edge of the previous back piece, and designating said next pattern line as the current pattern line, whereby allowance is made for the previous front piece to have a different width than that of the previous back piece.

* * * * *